US008251111B2

(12) United States Patent
Nelson et al.

(10) Patent No.: US 8,251,111 B2
(45) Date of Patent: Aug. 28, 2012

(54) BALLOON INFLATOR

(75) Inventors: David C. Nelson, Sharon Center, OH (US); Martin A. Meluch, Newton Falls, OH (US); Valent L. Meluch, Newton Falls, OH (US); Wesley A. Schroeder, Seville, OH (US)

(73) Assignee: Premium Balloon Accessories, Inc., Sharon Center, OH (US)

( * ) Notice: Subject to any disclaimer, the term of this patent is extended or adjusted under 35 U.S.C. 154(b) by 636 days.

(21) Appl. No.: 12/463,815

(22) Filed: May 11, 2009

(65) Prior Publication Data

US 2010/0065151 A1 Mar. 18, 2010

(51) Int. Cl.
*B65B 1/04* (2006.01)
*F01D 17/12* (2006.01)

(52) U.S. Cl. ..... 141/361; 141/67; 141/114; 141/197; 141/351; 415/148

(58) Field of Classification Search ..... 141/10, 141/31–317, 346, 347, 351, 352, 383, 361; 415/148
See application file for complete search history.

(56) References Cited

U.S. PATENT DOCUMENTS 3,368,742 A * 2/1968 La Plante et al. ..... 222/643
3,563,676 A * 2/1971 Coovert et al. ..... 417/410.1
3,994,324 A * 11/1976 Zeyra ..... 141/349
4,088,161 A 5/1978 Ikemoto
4,921,402 A * 5/1990 Nelson et al. ..... 415/148
5,121,595 A 6/1992 Shore
5,199,847 A * 4/1993 Nelson et al. ..... 415/148
5,651,402 A * 7/1997 McCaul ..... 141/314
5,653,272 A * 8/1997 McCaul ..... 141/314
6,119,738 A * 9/2000 Idol ..... 141/114
6,295,693 B1 * 10/2001 Chou ..... 15/330
6,413,056 B1 * 7/2002 Chou ..... 417/366
6,634,394 B1 * 10/2003 Nelson et al. ..... 141/114
7,147,016 B1 * 12/2006 Nelson et al. ..... 141/114
7,641,668 B2 * 1/2010 Perry et al. ..... 606/192

* cited by examiner

*Primary Examiner* — Timothy L Maust

(74) *Attorney, Agent, or Firm* — Renner Kenner Greive Bobak Taylor & Weber

(57) ABSTRACT

A balloon inflator includes a nozzle adaptor configured to fit over an outlet of an inflation nozzle. A nozzle receipt is provided by the balloon inflator housing to selectively receive the nozzle adaptor and a switch is provided at the nozzle receipt. The nozzle adaptor is adapted to trigger the switch when received at the nozzle receipt. The switch controls the power supplied to the motor, such that different motor operating parameters are realized when the switch is triggered and when the switch is not triggered. In a particular embodiment, the nozzle adaptor includes vent channels that exhaust a portion of the air to the atmosphere when a balloon is fitted over the alternate outlet.

12 Claims, 13 Drawing Sheets

BALLOON INFLATOR

TECHNICAL FIELD

The invention herein resides in the art of inflation devices and relates to a balloon inflator that employs a bypass motor having separate working air and motor cooling air paths. The invention further relates to a balloon inflator having a fill nozzle and a plurality of adaptors that fit on said fill nozzle to fill different types of balloons. The invention also relates to a balloon inflator having at least one switch actuated by at least one adaptor in order to change the operating parameters of the balloon inflator.

BACKGROUND ART

Various types of balloon inflators have previously been known. Typically, such inflators incorporate a through-flow motor which draws air from the surrounding atmosphere and exhausts it through an air duct providing an inflation nozzle adapted to receive the neck of a balloon. Accordingly, the air used for inflating the balloon is the same air that is drawn through the motor to cool it. As the motor works, its temperature rises. This is aggravated by the use of narrow inflation nozzles to receive the balloon neck. The narrow nozzle restricts the air flow and accordingly raises the motor temperature. This is particularly true when a large number of balloons are being inflated in succession, for each balloon constitutes a motor load that varies as the balloon inflates. As a result, the motors of such inflators are given to quick wear-out after operating at continuously high temperatures. Furthermore, as the temperature of the motor rises, the balloons are inflated with increasingly warmer air, and, as a result, after the balloon is inflated and the neck sealed, the balloon deflates as the warm air cools and provides less pressure.

To address this problem the art has provided an inflator employing a bypass motor that drives a fan held within a fan chamber to provide working air (i.e., air for inflation), and separates this working air from motor cooling air, resulting in an inflator that exhibits less heat build up. This balloon inflator is provided in U.S. Pat. No. 5,199,847, which establishes the state of the art of balloon inflators at this point in time. However, the balloon inflator taught by this prior patent, while constituting an improvement over its prior art, is herein improved to provide a balloon inflator adapted to fill different types of balloons, including latex balloons, small foil balloons lacking self-sealing valves, and larger foil balloons that include self-sealing valves in their neck portion.

The balloon inflator of U.S. Pat. No. 5,199,847 typically provides inflation pressures of from 80 to 95 inches of water (4° C.). While such pressures are suitable for most latex balloons and small foil balloons lacking self-sealing valves, it has been found that these pressures can force the self-sealing valve out of the neck of a large foil balloon. Thus, the prior art has failed to provide a single balloon inflator unit that can safely fill multiple types of balloons, including particularly latex balloons, small foil balloons, and large foil balloons including self-sealing valves.

Additionally, the prior art balloon inflator of U.S. Pat. No. 5,199,847 has been found to suffer from the high temperature problem previously disclosed herein. That is, despite of the employment of a bypass motor, continuous operation of the prior art balloon inflator can result in a raising of the bypass motor temperature to a point where the air filling the balloons is too warm, and, as a result, there is still a potential for balloons to deflate to some extent after the initial inflation. This is been found to be particularly true with larger foil balloons, such that there is a particular need for a balloon inflator that will adjust its operating parameters in accordance with a particular type of balloon being inflated. Currently, the need is most appreciated with respect to large foil balloons wherein high operating pressures have been shown to blow the self-sealing valve out of the balloon neck, and high operating temperature have been found to result in a deflation of the balloon after the initial inflation.

The prior art balloon inflator of U.S. Pat. No. 5,199,847 provided a fan inside of an involute to provide air to an inflation nozzle at the top of the inflator housing. This nozzle was free-floating with respect to a collar portion of the housing, and could be made to assume two positions, a first, lowered position in which the nozzle engaged the involute to receive all of the inflation air generated by the fan, and second, raised position in which the nozzle was raised off of the involute such that a portion of the inflation air generated by the fan would exit the involute in the interior of the housing and travel down through the housing, over the fan motor, and out a bottom exhaust. A portion of the air would also exit through the inflation nozzle. This movable nozzle was provided to aid in keeping the operating temperature down by limiting the amount of resistance encountered by the fan motor, but it has been found still to be too restrictive since the air to be exhausted must still travel through the housing to exit at the bottom exhaust.

SUMMARY OF THE INVENTION

In one embodiment of this invention, a balloon inflator includes a housing, a motor within the housing, and a fan operable by the motor to drive air to an inflation nozzle. The inflation nozzle provides an outlet. A nozzle adaptor is configured to fit over the outlet of the inflation nozzle and provide an alternate outlet. A nozzle receipt is provided by the housing to selectively receive the nozzle adaptor and a switch is provided at the nozzle receipt. The nozzle adaptor is selectively received at the nozzle receipt so as to trigger the switch, and is selectively removed from the nozzle receipt so as to not trigger the switch. The switch controls the power supplied to the motor, such that different motor operating parameters are realized when the switch is triggered and when the switch is not triggered.

In another embodiment, a balloon inflator includes a housing, a motor within the housing, and a fan operable by the motor to drive air to an inflation nozzle, the inflation nozzle having an outlet. A nozzle adaptor is configured to fit over the outlet of the inflation nozzle and provide an alternate outlet for the air driven by the fan. The nozzle adaptor includes vent channels that exhaust a portion of the air to the atmosphere when a balloon is fitted over the alternate outlet to receive air driven through the nozzle and the nozzle adaptor.

BRIEF DESCRIPTION OF DRAWINGS

For a complete understanding of the objects, techniques and structure of the invention, reference should be made to the following detailed description and accompanying drawings wherein.

DETAILED DESCRIPTION OF THE PREFERRED EMBODIMENTS

Figure 1:
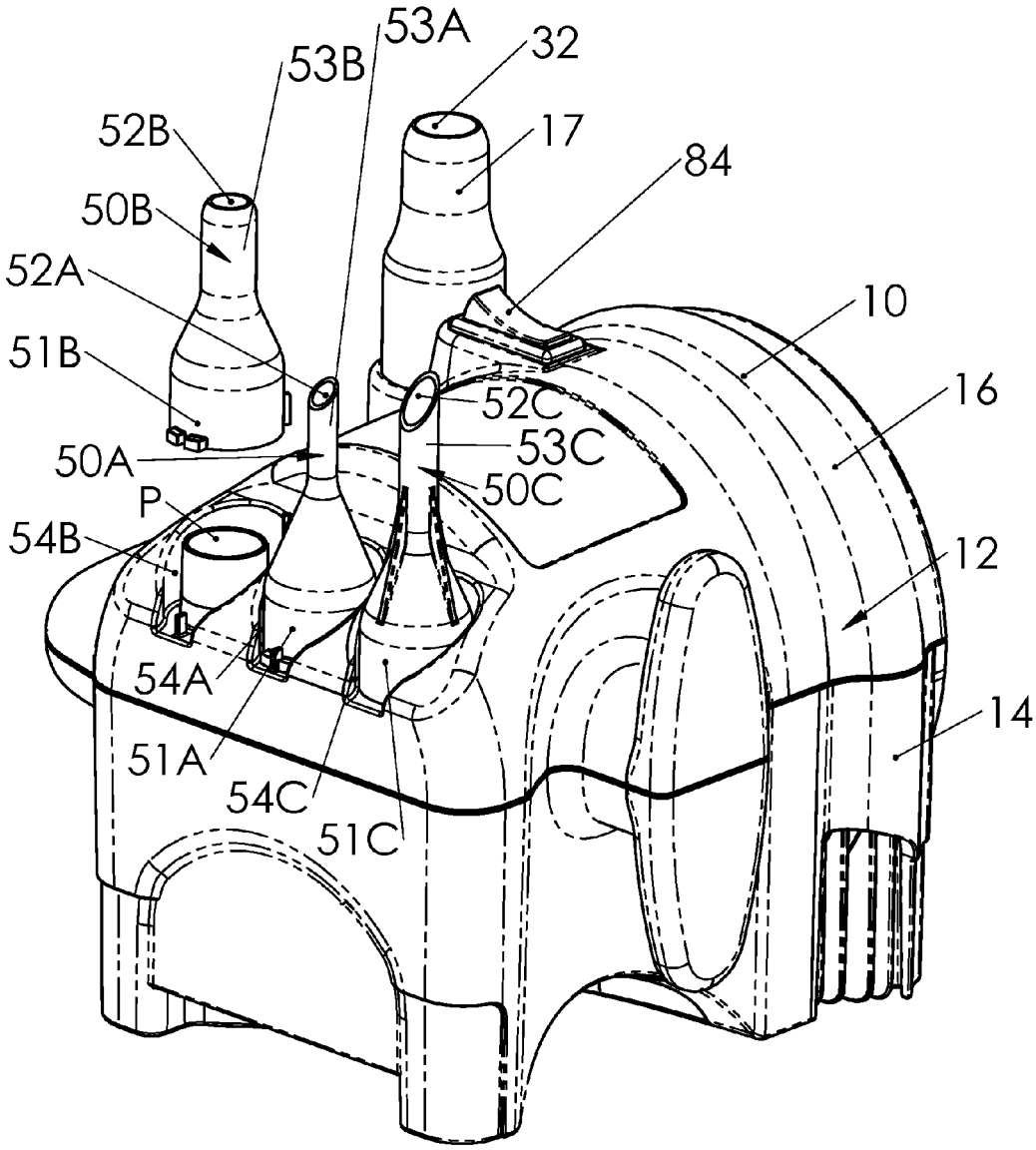
FIG. 1 is a perspective view of a balloon inflator according to the invention.
Figure 2:
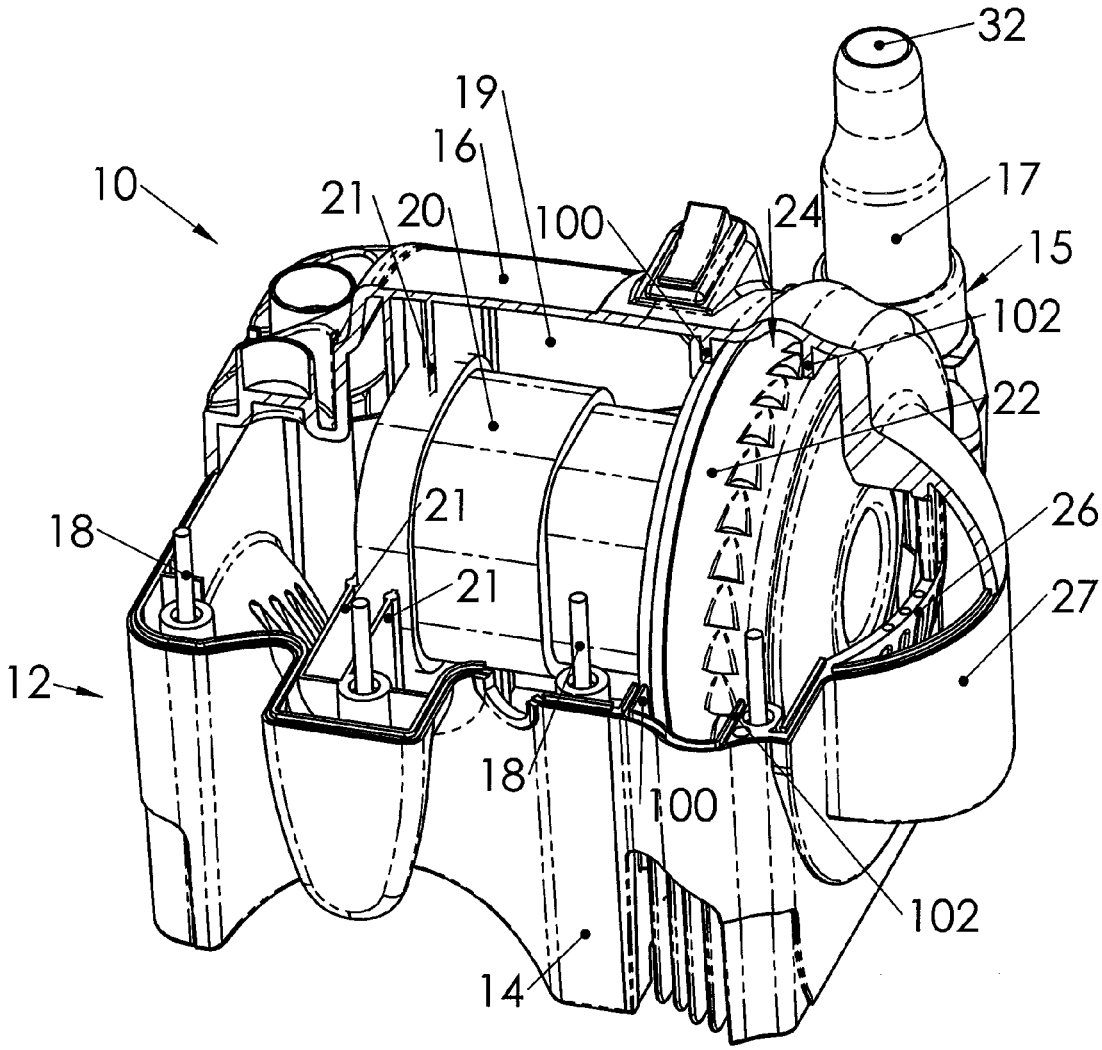
FIG. 2 is a perspective view in partial cross section of the inflator of FIG. 1.
Figure 3:
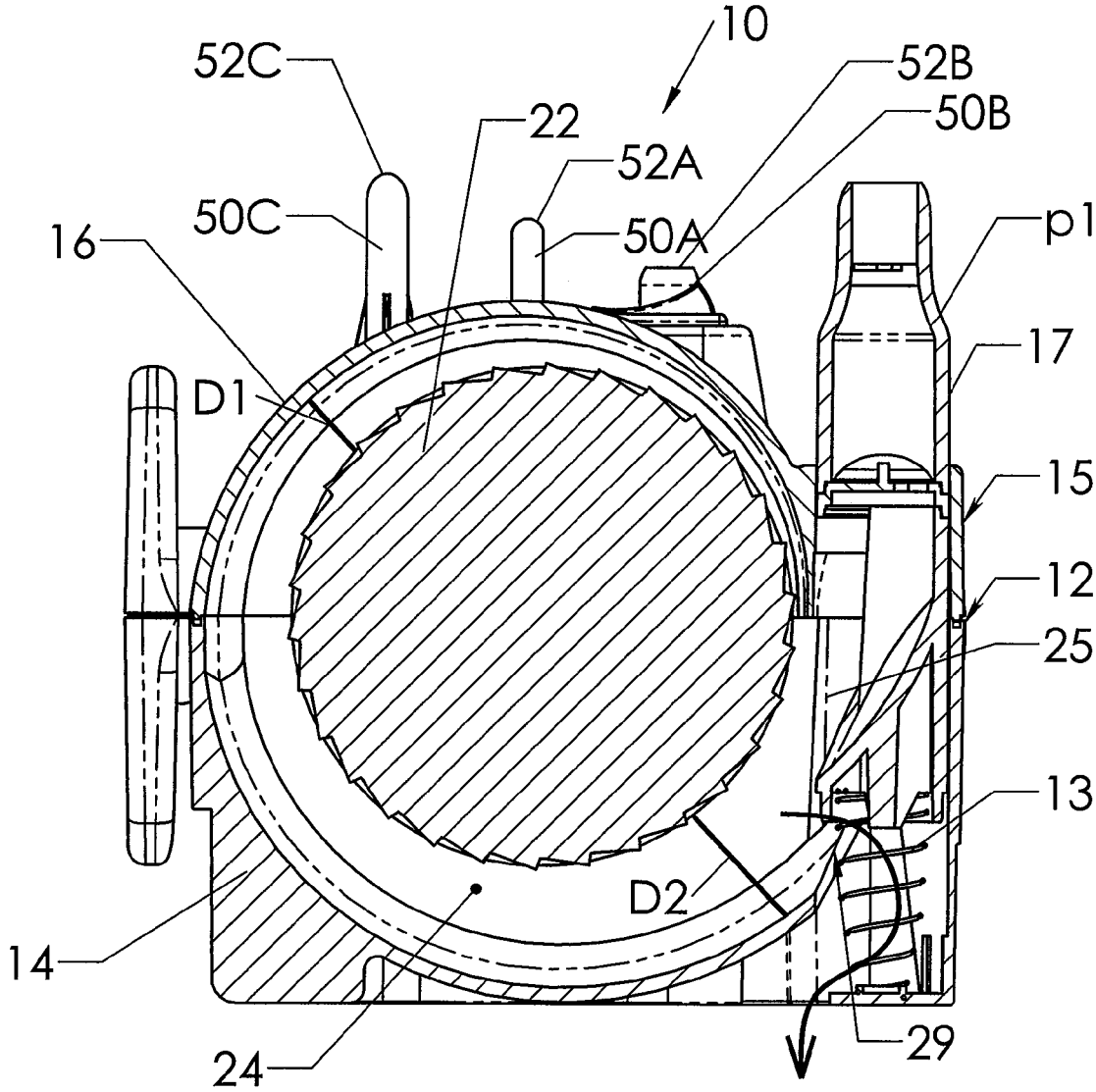
FIG. 3 is a cross section of the inflator of FIG. 1 viewed from the air intake side as represented in the smaller top plan view also provided in FIG. 3; wherein the inflation nozzle is shown in a bypass position that is also its rest position.

Referring now to the drawings and more particularly FIGS. 1-3, it can be seen that a balloon inflator according to this invention is designated generally by the numeral 10. As shown, the balloon inflator 10 includes a housing 12, which may be of any suitable material and construction. Preferably, and in accordance with a most preferred embodiment, the housing 12 is formed of two halves, a first housing portion 14 and a second housing portion 16, and an inflation nozzle 17. The first housing portion 14 and the second housing portion 16 are joined by interaction of male members 18 and appropriately shaped and positioned female members (not shown) that receive male members 18. Such construction facilitates manufacturing and assembly. By way of example only, male members 18 may be screw fasteners mating with threaded bores (female members) on second housing portion 16. The inflation nozzle 17 is received in a nozzle receipt portion 15 of the joined first and second housing portions 14, 16, and moves therein as will be described more fully below. A flange on the second housing portion 16 interacts with a flange on the inflation nozzle to prevent the inflation nozzle from being removed upwardly out of the remainder of the balloon inflator 10.

Notably, housing 12 is formed of three pieces, with the inflation nozzle 17 being movable on a spring 13 relative to its receipt in the nozzle receipt portion 15 formed by the first housing portion 14 and second housing portion 16. This construction, having only three major pieces and a spring, yields a balloon inflator 10 that operates at reduced noise levels inasmuch as there are few construction parts to be joined together. Each joinder of a construction part provides a potential area for leaks that would increase noise production and lead to a loss of power. Thus, this simple three piece construction leaks less and provides benefits respecting noise and power production.

The housing 12 is preferably a molded plastic housing defining a cavity 19 for receiving and maintaining a bypass motor 20 therein. Support members, such as those indicated at 21, in FIG. 2, may be employed to help secure the motor 20 in position within the housing 12. The motor 20 drives a fan 22 retained within a fan chamber 24. Advantageously, the fan chamber 24 includes a first sealing rib 100 and a second sealing rib 102, both of which intimately contact the fan 22 around its circumference to further seal off noise producing elements (namely, fan 22 and motor 20) and muffle noise. The fan 22 draws in air at an intake opening 26, which is covered by a shroud 27 to also help muffle the noise of operation of the motor 20. The fan 22 generates working air (i.e., air for inflation of balloons) that is directed from the fan chamber 24 to the inflation nozzle 17.

Figure 4:
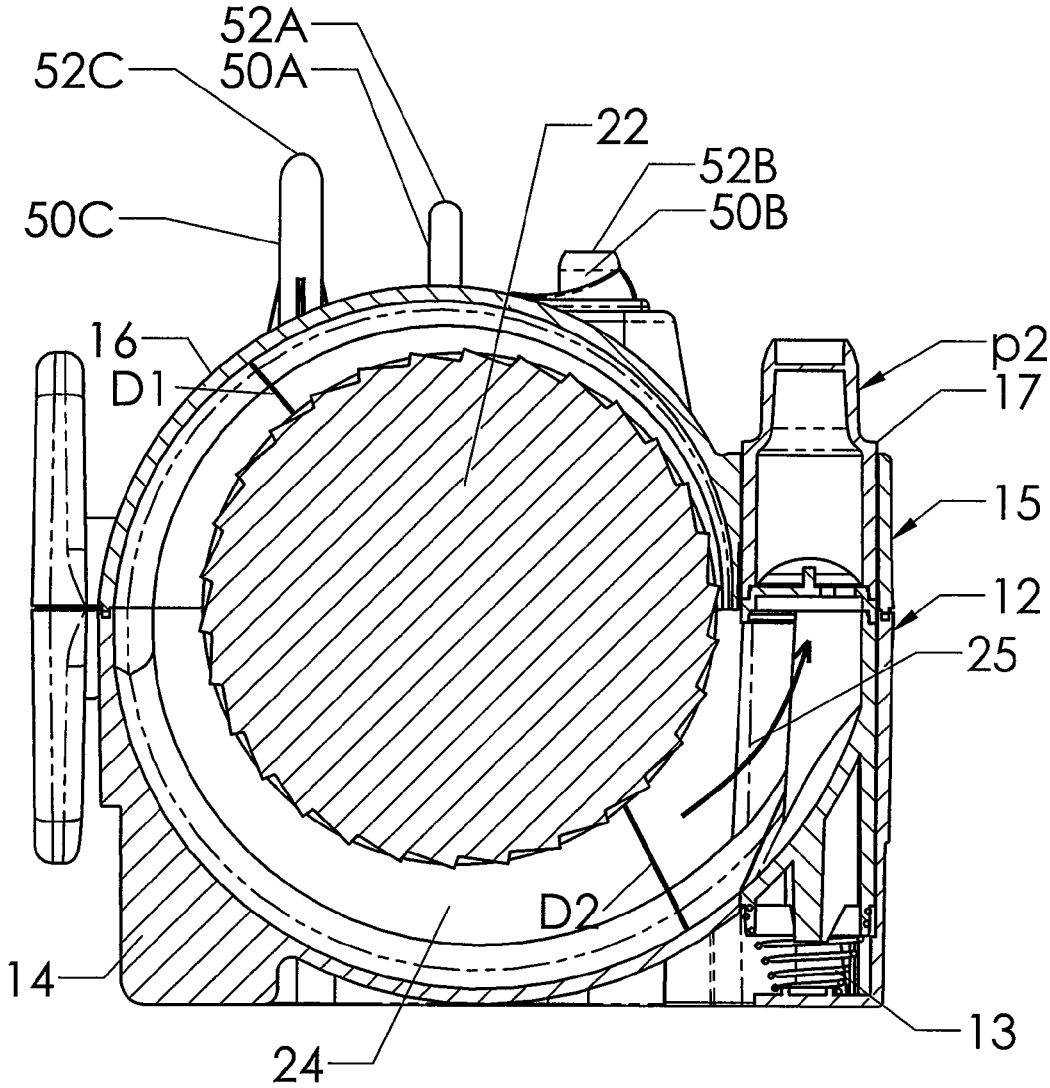
FIG. 4 is a cross section of the inflator as in FIG. 3, showing the inflation nozzle in a way fill position.

With reference to FIG. 3, the inflation nozzle 17 is movable. When the inflation nozzle 17 is in a rest position p1 (FIG. 3) much of the air drawn into the fan chamber 24 passes out through an exhaust opening 29 formed in the first housing member 14, because the exhaust opening 29 is left uncovered in light of the raised rest position p1 of the inflation nozzle 17. When the inflation nozzle 17 is in a fill position p2 (FIG. 4), the air drawn into fan chamber 24 passes from the chamber 24 into the inflation nozzle 17, through the inlet 25 of the inflation nozzle 17, and, from there, the air passes out of the outlet 32. Preferably, the fan chamber 24 is provided in the form of an involute to achieve desired air velocity and pressure at the inflation nozzle 17 for introduction into a balloon received thereon in communication with the outlet 32. Notably, as opposed to the structure provided in U.S. Pat. No. 5,199,847, the exhaust from the involute is proximate the bottom of the housing 12, and follows the general path of the inflation air. Thus, when the nozzle is in the rest position p1, much of the air quickly exits the housing, providing little resistance for the fan motor 20. This reduces the operating temperature of the balloon inflator 10 as compared to the temperatures reached by the balloon inflator of U.S. Pat. No. 5,19,847, having an exhaust that forced the air to be exhausted by traveling through the interior volume of the housing, thus providing additional resistance to the motor.

Figure 8:
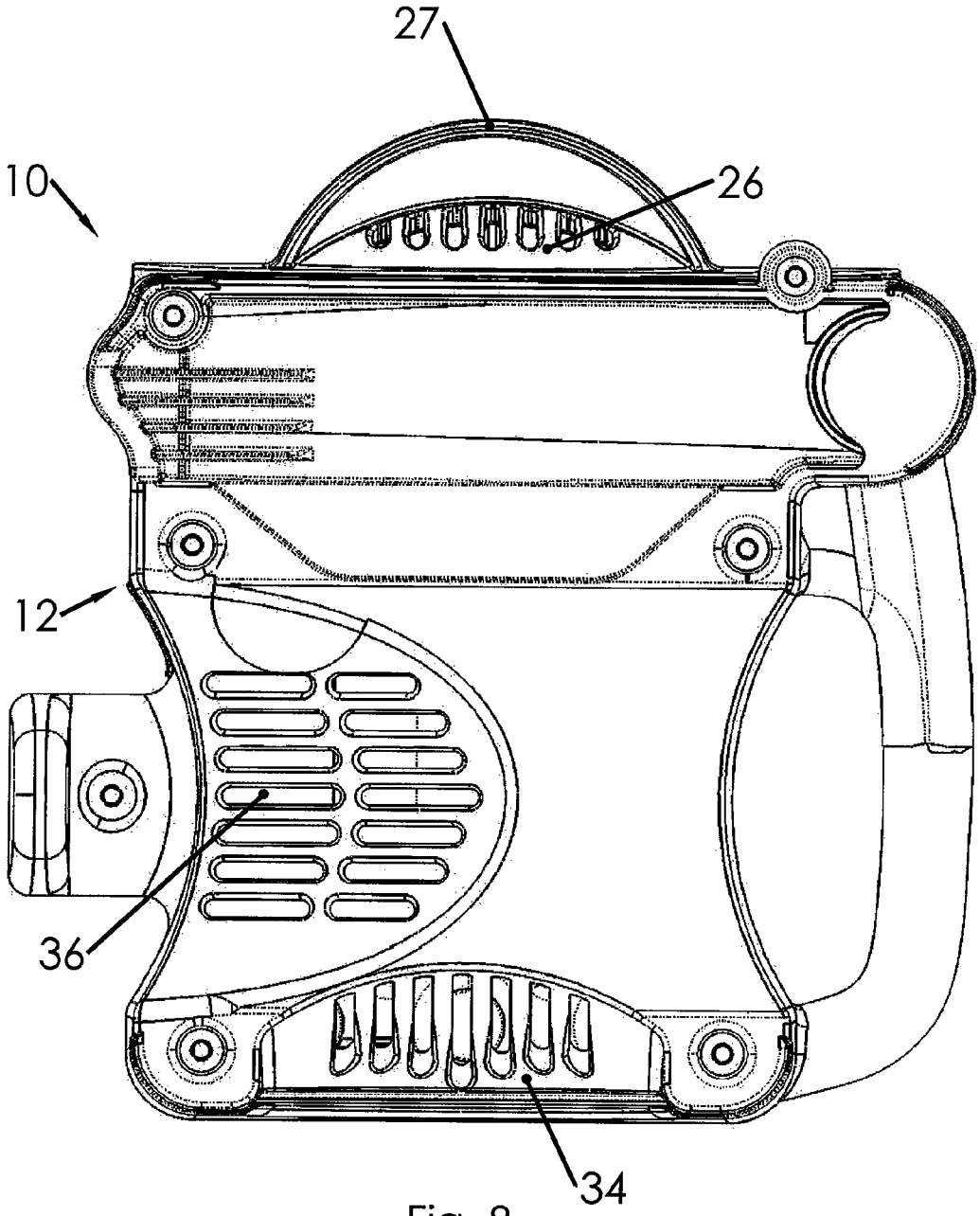
FIG. 8 is a bottom plan view of the balloon inflator of FIG. 1.

With reference to FIG. 8, it can be seen that a cooling air inlet 34 is provided for communication with the interior of the housing 12 receiving the motor 20. Accordingly, the cooling air inlet 34 provides a means for drawing motor cooling air into the housing 12 and through the windings of the motor 20 to cool the same. For this purpose, a motor cooling fan (not shown) or the like would be provided with the motor 20, as is standard with bypass motors of the type preferably implemented herein. Such bypass motors that provide separate sources of working and motor cooling air are well known. The motor cooling air is exhausted out of exhaust vent 36, after passing through and cooling the bypass motor 20.

At full power, the bypass motor 20 preferably operates at between 500 and 800 watts, more preferably, between 550 and 700 watts, and, in a particular embodiment, bypass motor 20 operates at about 600 watts (plus or minus about 10%). At full power, the bypass motor 20 preferably drives the fan 22 to generate pressures of from 80 to 95 inches of water (4° C.) at the outlet 32. In other preferred embodiments, the bypass motor 20 generates pressures of from 82 to 90 inches of water (4° C.), and, in a particular embodiment, the bypass motor 20 generates a pressure of from about 80 to 85 inches of water (4° C.). A less than full power operation is disclosed herein below.

It should now be readily appreciated by those skilled in the art that only ambient air drawn through the intake opening 26 and into the fan chamber 24 is introduced into the interior of a balloon received upon the inflation nozzle 17. No motor cooling air is allowed to enter the balloon. By selecting the motor 20 to be a bypass motor, keeping motor cooling air and working air separated, the air introduced into the interior of the balloon is maintained closer to ambient temperature, such that the risk of shrinking upon cooling is significantly reduced and the life of the motor is extended by avoiding excessive overheating.

Those skilled in the art will also appreciate that the bypass nature of motor 20, separating the working air and motor cooling air, greatly reduces the operating temperature of the motor 20. Similarly, separation of the cooling air inlet 32 from the exhaust vent 36 also reduces the operating temperature. Accordingly, the balloon inflator 10 may run continuously without the excessive heat buildup characteristic of inflators using standard through flow motors. Such prior inflators typically required cool down times of 10-15 minutes for every 20-25 minutes of use, such a duty cycle being ineffective and a waste of costly inflation time. The balloon inflator 10 improves usage efficiency over the flow through motor prior art and allows continuous motor use without excessive heat buildup.

In accordance with particularly preferred embodiments of this invention, the fan chamber 24 is provided in the form of an involute. Those skilled in the art will understand that as the working air decelerates from the fan 22, it trades velocity for air pressure. Such a trade-off in an involute is extremely efficient. As the working air passes through the fan chamber 24, it passes to areas of increasing cross sectional area (see FIGS. 3 and 4, and a comparison of lines D1 and D2) such that the velocity of air decreases while the air pressure increases. The cross section increases in both width and height. Additionally, the fan chamber 24 includes a first sealing rib 100 and a second sealing rib 102, both of which intimately contact the fan 22 around its circumference to substantially seal the working air within the preferred involute fan chamber 24. Accordingly, an optimum air pressure is achieved at the inflation nozzle 17 and the outlet 32. Consequently, the motor size can be minimized, along with incident noise, without adversely impacting the effectiveness or efficiency of inflator 10.

The inflators of this invention also benefit from the provision of means for providing for various operation parameters, allowing for the selection of different air pressures for various balloons to be inflated. For example, for reasons already provided in the background section above, larger foil balloons with self-sealing valves should be inflated at a lower pressure or rate than latex balloons or smaller foil balloons without self-sealing valves. Accordingly, this balloon inflator 10 provides means for controlling the speed of the motor 14 and thus the pressures and temperatures produced thereby.

It should be appreciated that a balloon, particularly a latex balloon, can be fitted directly over the outlet 32 of the inflation nozzle 17. However, in order to further facilitate the filling of various types and sizes of balloons, various nozzle adaptors are provided. This embodiment provides three different nozzle adaptors, identified as nozzle adaptors 50A, 50B, and 50C. These nozzle adaptors 50A, 50B, 50C sealingly engage inflation nozzle 17, at inlet ends 51A, 51B, 51C, and taper to narrow outlet ends 53A, 53B, 53C to provide alternate outlets 52A, 52B, 52C, respectively. It will be appreciated that the different shapes provide for interaction with different types and sizes of balloons. To ensure that such nozzle adaptors 50A, 50B, 50C do not become lost or misplaced, housing 12 includes a plurality of adaptor holders 54A, 54B, 54C that securely retain a respective accessory inflation nozzle 50A, 50B, 50C. More particularly, as seen in FIGS. 1, 6 and 7, each nozzle adaptor 50A, 50B, 50C fits over a post P within holders 54A, 54B, 54C, and each nozzle adaptor 50A, 50B, 50C includes a specific tab 56A, 56B, 56C that will dictate how a given nozzle adaptor 50A, 50B, 50C can interact with a given holder 54A, 54B, 54C.

Figure 6:
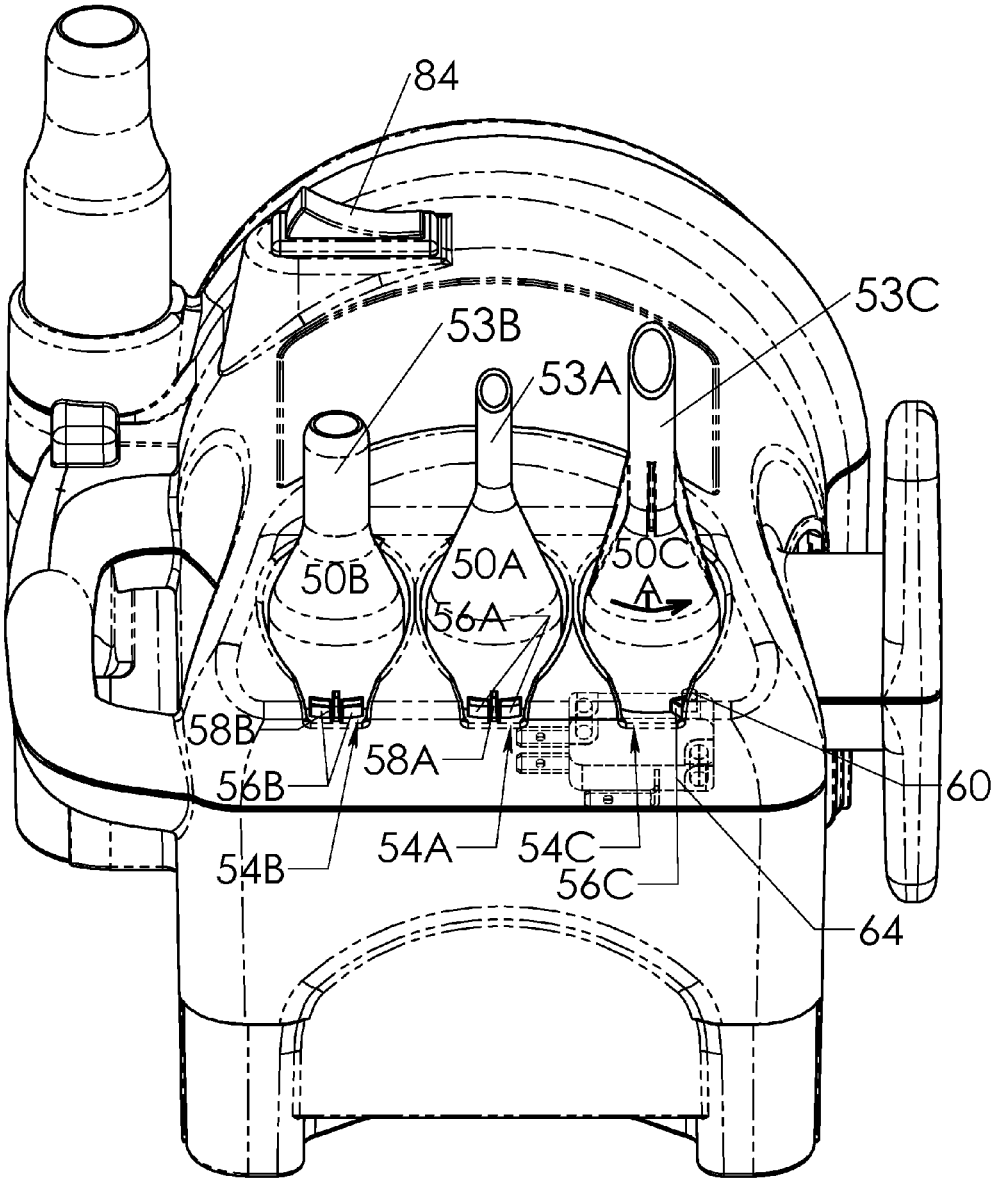
FIGS. 6 and 7 are perspective views of the nozzle holder portion of the balloon inflator, showing how different nozzle adaptors are keyed for receipt on individual nozzle holders, and how at least one nozzle adaptor interacts with a switch for changing the operating parameters of the balloon inflator.
Figure 7:
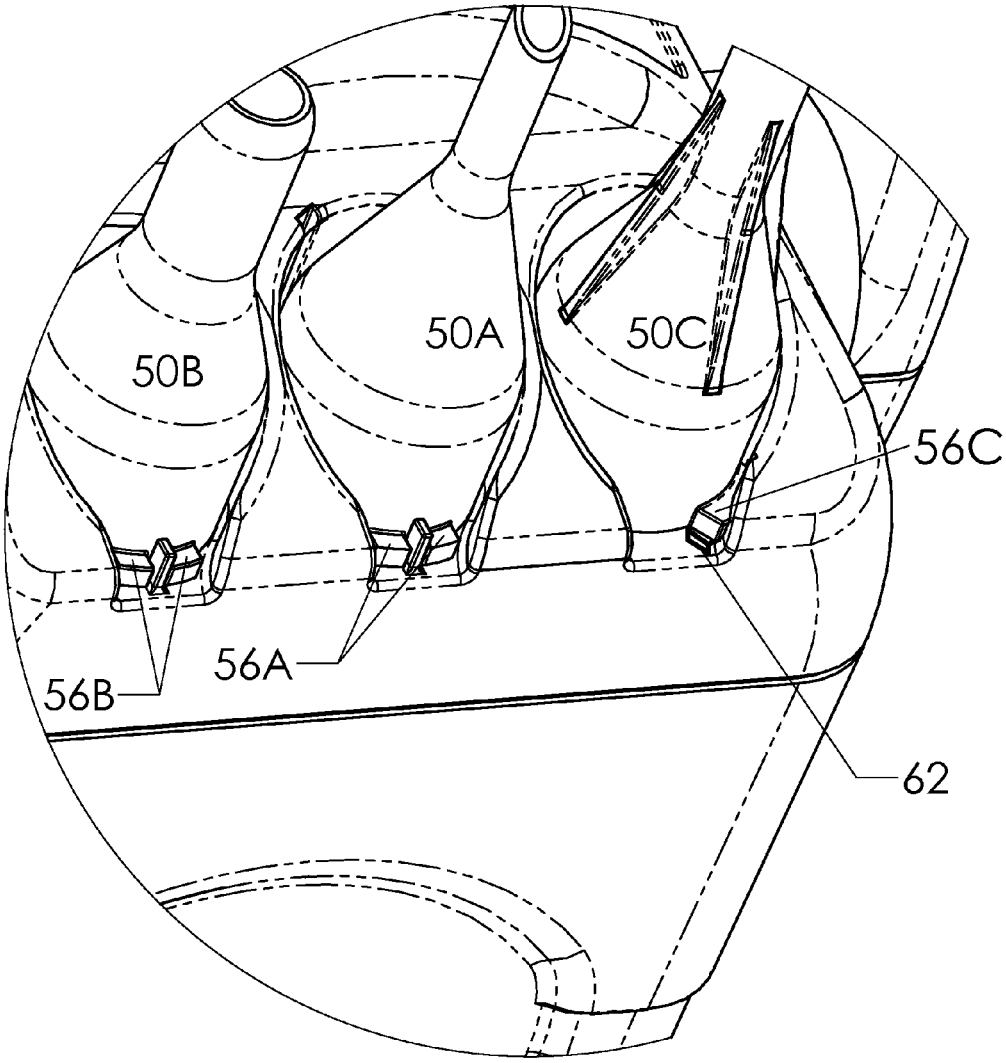

As best seen in FIGS. 6 and 7, the nozzle 50A, which in this embodiment is provided to fill small foil balloons, includes a keyed tab 56A specifically shaped to fit over a key 58A provided at holder 54A. Similarly, nozzle adaptor 50B is provided to fill latex balloons, and includes a keyed tab 56B adapted to fit over key 58B provided at holder 54B. Although these keyed tabs 56A, 56B are shown to be similar, they may also be shaped differently to fit over different keys so that each adaptor 50A, 50B, 50C would have only one area where it is capable of being received. As shown in the embodiment of FIG. 6, the location of nozzle adaptor 50A and 50B could be switched in light of the fact that their keyed tabs 56A and 56B are identical and fit over similar keys 58A, 58B.

Figure 5:
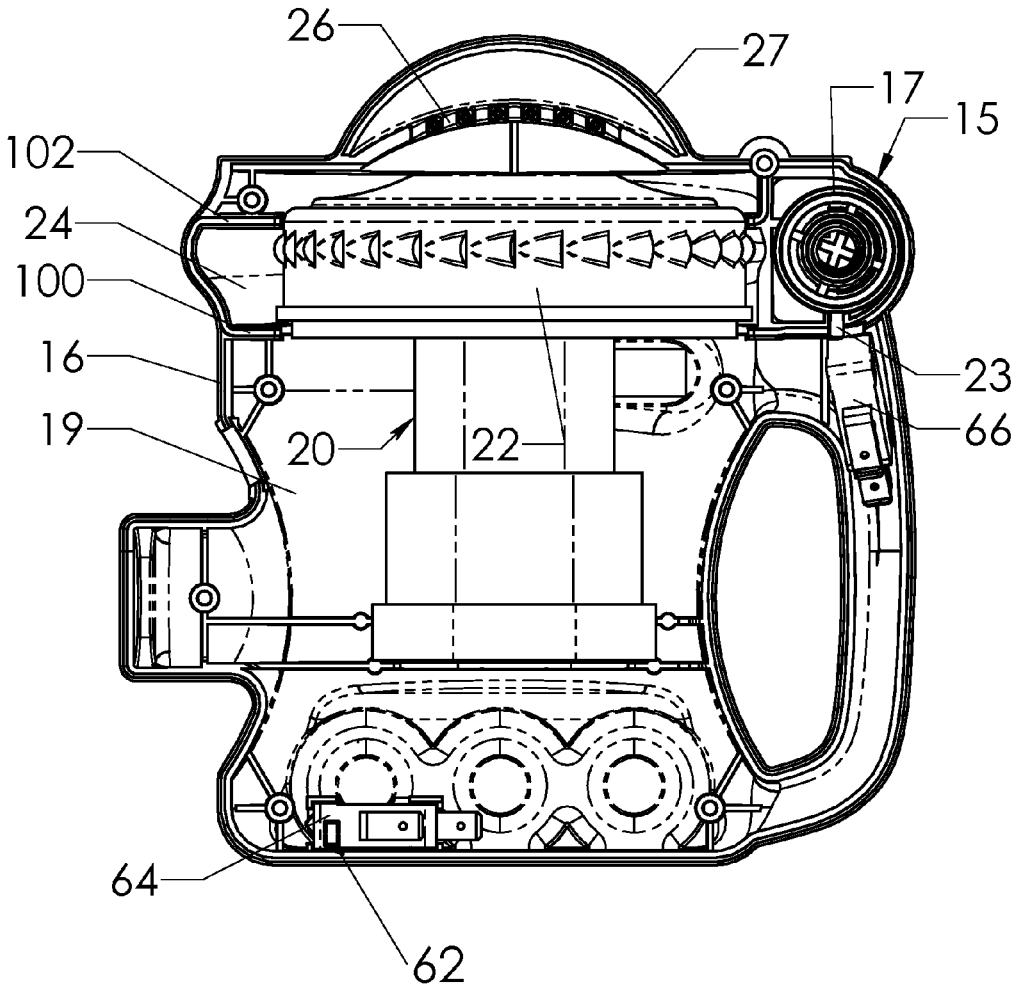
FIG. 5 is a bottom view of the balloon inflator wherein the first housing portion has been removed to show internal switch elements.
Figure 9:
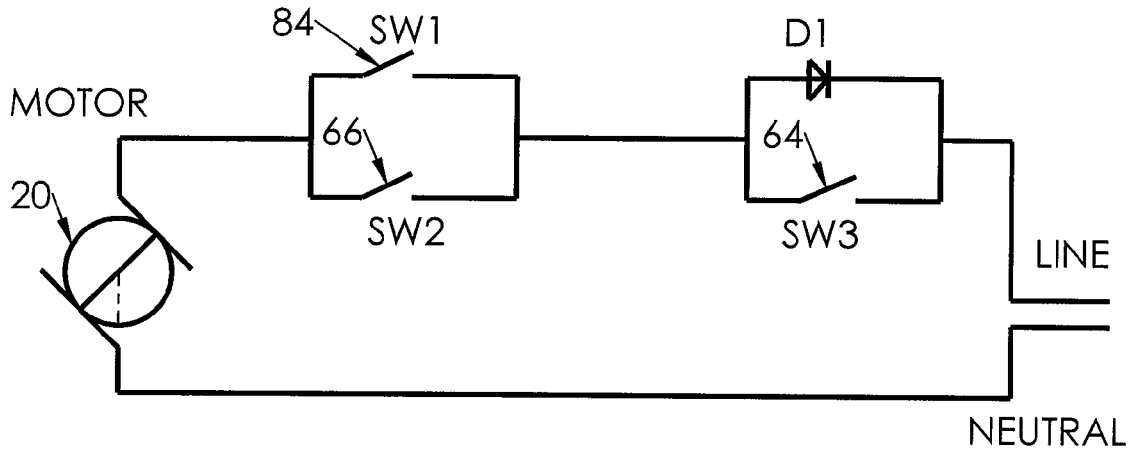
FIG. 9 is a schematic view of the circuitry employed in the balloon inflator.

In this embodiment, nozzle adaptor 50C is provided to fill large foil balloons, and includes a tab 56C that is adapted to fit under a flange 60 provided in holder 54C. Placing the tab 56C under the flange 60 forces a switch actuator 62 downwardly to change the operating parameters of the balloon inflator 10. More particularly, a switch 64 is provided in the interior of the housing 12, and this switch 64 provides the switch actuator 62 that extends upwardly through the housing 12 to be exposed at holder 54C, under the flange 60. By inserting the nozzle adaptor 50C over its post P at holder 54C and rotating the adaptor 50C in the direction of arrow A, the tab 56C forces the switch actuator 62 downwardly to close a momentary snap-action switch 64. With reference to FIG. 9, this closes the circuit at 64, such that power to the motor 20 is dictated by the position of the rocker switch 84 and the position of the inflation nozzle 17, which controls a momentary snap-action switch 66 (FIG. 5). With the large foil balloon nozzle adaptor 50C properly secured at holder 54C to depress the switch actuator 62, switch 64 is closed, and, to provide power to the motor 20, either the rocker switch 84 can be closed by turning it to an "on" position, or, with the rocker switch 84 open (in an "off" position), the nozzle inflator 17 can be pushed downwardly to its position in FIG. 4 to close switch 66. More particularly, as seen in FIG. 5, switch 66 is provided in close proximity to the inflation nozzle 17, and pressing down on nozzle 17 to the position of FIG. 4 (wherein the working air of the fan 22 is forced into and through the inflation nozzle 17) causes a tab 23 on the inflation nozzle 17 to hit and actuate the switch 66.

So long as the nozzle adaptor 50C is received at holder 54C to depress the actuator switch 64, turning the rocker switch 84 on or pressing downwardly on the inflation nozzle 17 causes the motor 20 to operate at full power, with the entire wave form of the alternating current (AC) passing through switch 64 and either switch 84 or switch 66 as the case may be. When the nozzle adaptor 50C is removed from holder 54C, the switch actuator 62 raises, opening switch 64 to thereby force the current through a diode D1. The diode D1 permits only half of the wave form of the alternating current to pass through the circuit to energize the motor, dependant upon the state of either switch 66 or switch 84. This lowers the heat and pressure generated by the motor 20 and the fan 22, and also decreases power consumption. The pressure is lowered approximately 50%. Thus the inflating air is presented to the balloon at a decreased temperature and pressure. This lowering of the pressure and temperature is associated with the removal of the nozzle adaptor 50C since that nozzle adaptor 50C is to be used to fill the larger foil balloons having self-sealing valves. It will be recalled that the large foil balloons can be negatively impacted by the introduction of air at too high of a pressure or too high of a temperature, and, thus, limiting the pressure and temperature when an adaptor 50C is removed from its holder 54C and placed on an inflation nozzle 17 is very beneficial.

Figure 10:
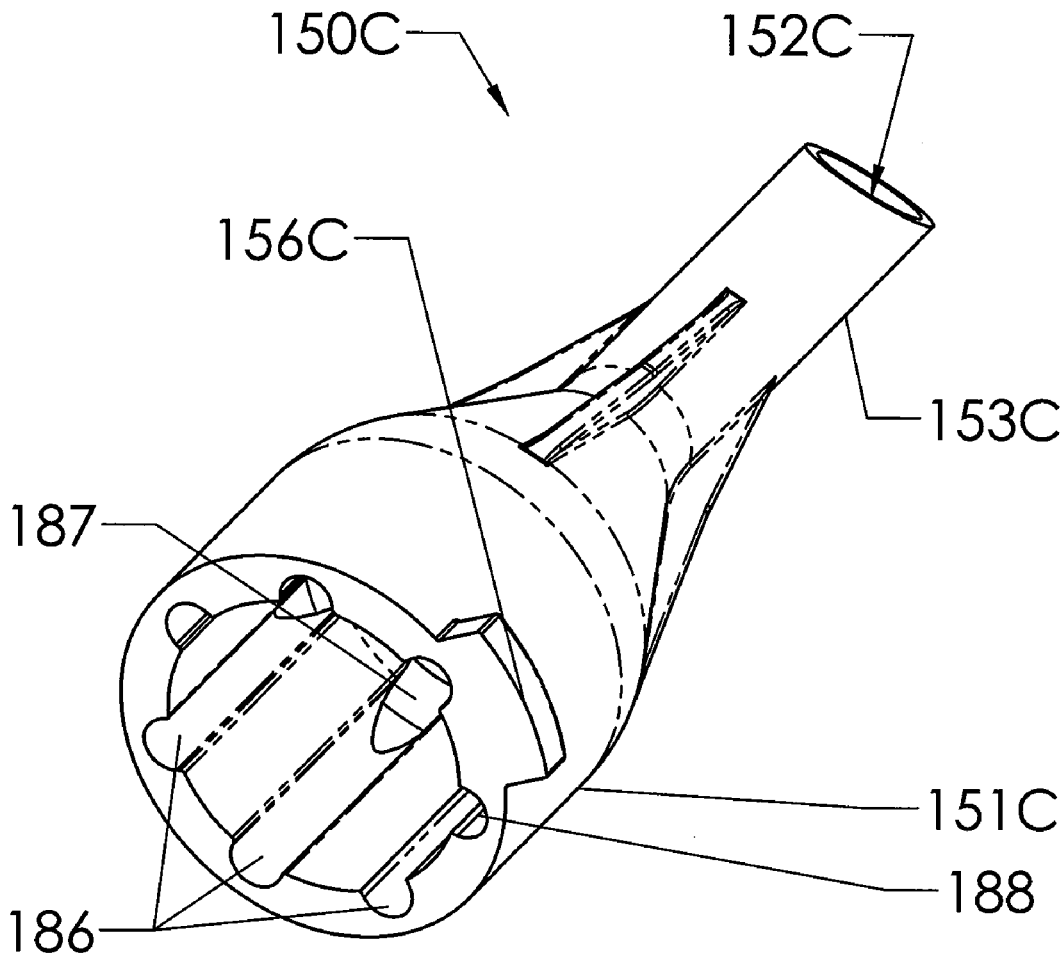
FIG. 10 is a perspective view of an alternative embodiment for a nozzle adaptor.
Figure 11:
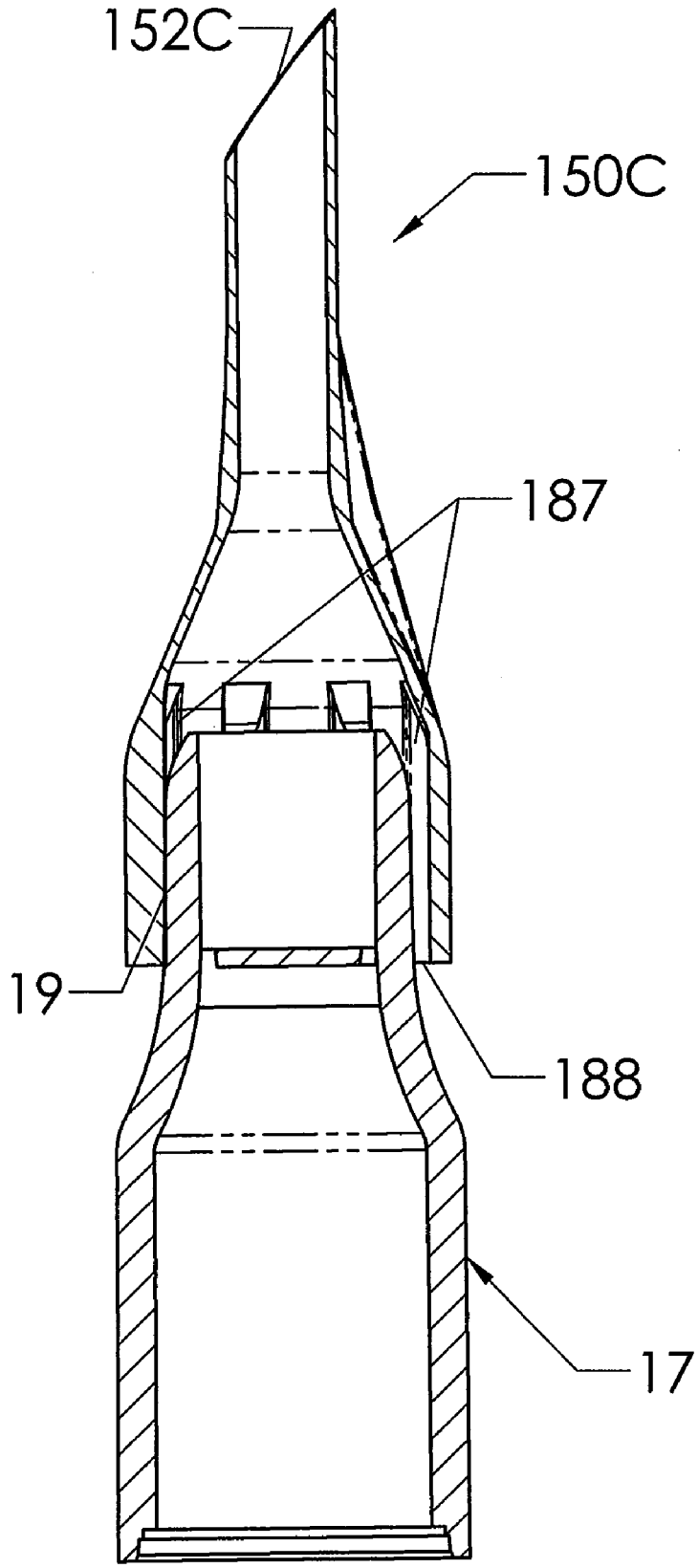
FIG. 11 is a cross sectional view of the nozzle adaptor of FIG. 10, shown mounted on the inflation nozzle of the balloon inflator to show flow paths of air.
Figure 12:
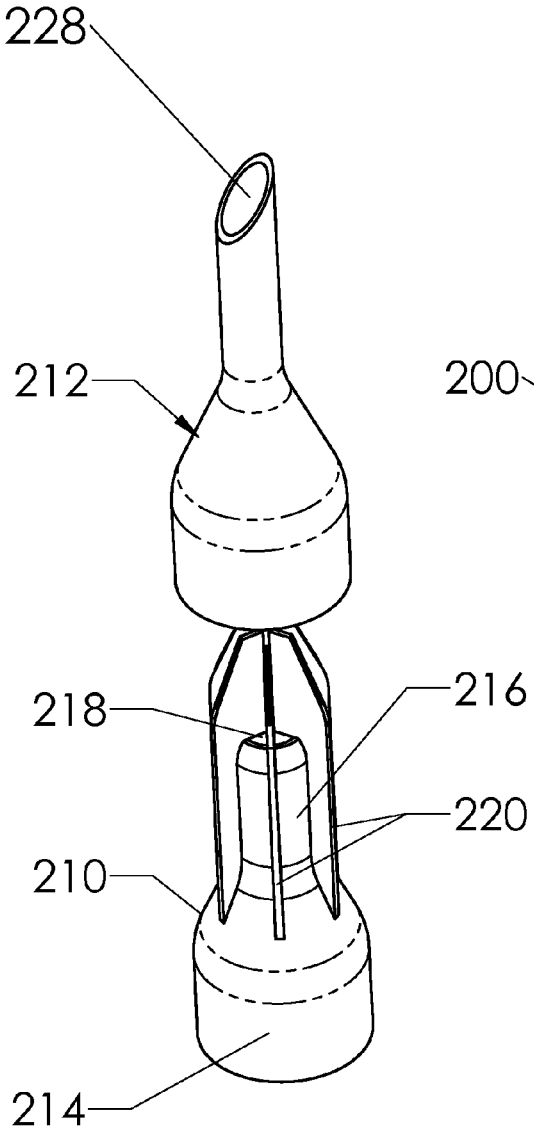
FIG. 12 is a perspective view of an alternative embodiment of a stacked nozzle adaptor assembly, shown with the two nozzles separated and aligned for stacking.
Figure 13:
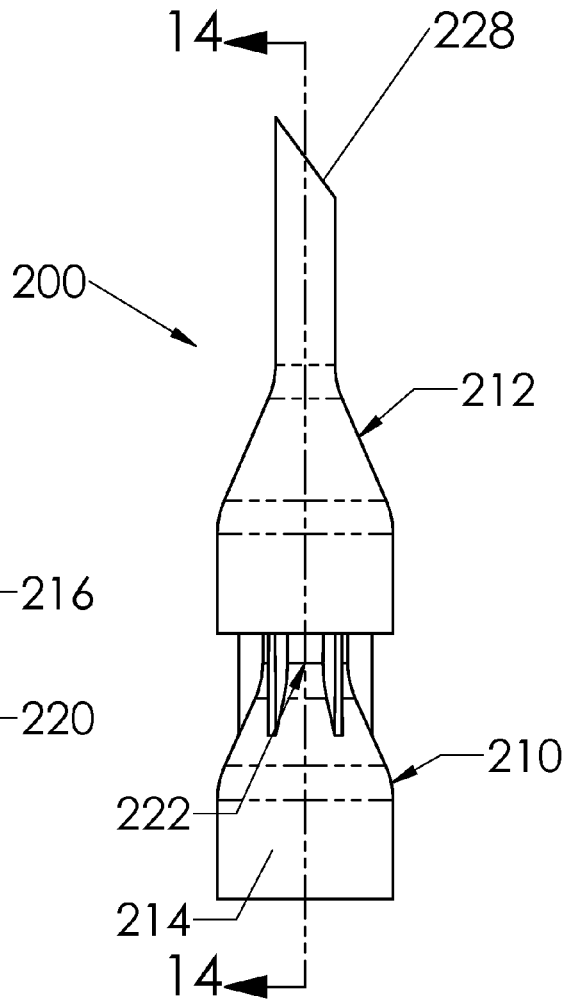
FIG. 13 is a perspective view of the alternative embodiment of FIG. 12, shown with the two nozzle stacked.
Figure 14:
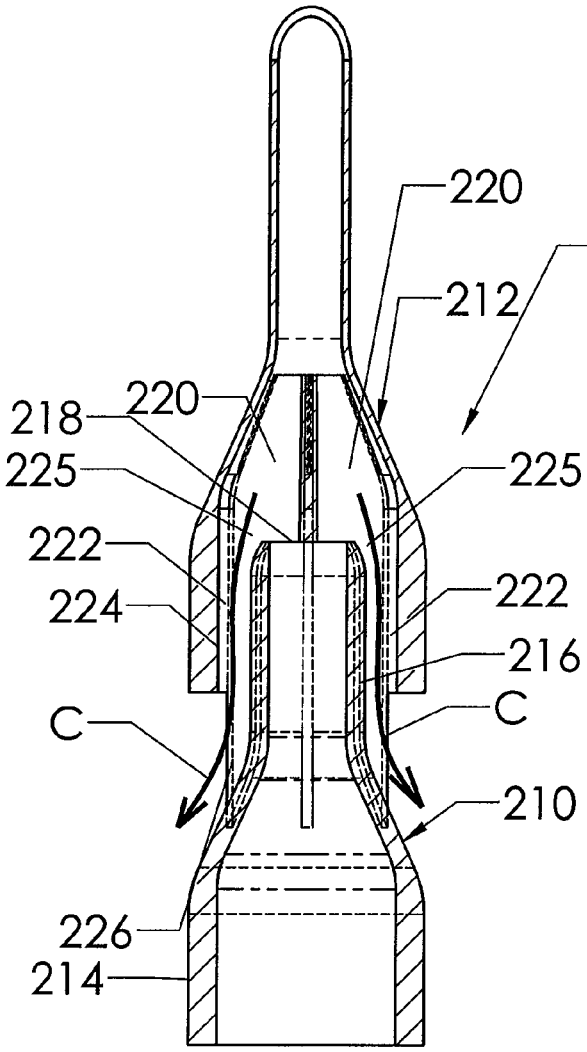
FIGS. 14 and 15 are cross sectional views of the stacked nozzle adaptor assembly of FIG. 13, and are provided to show flow paths of air.
Figure 15:
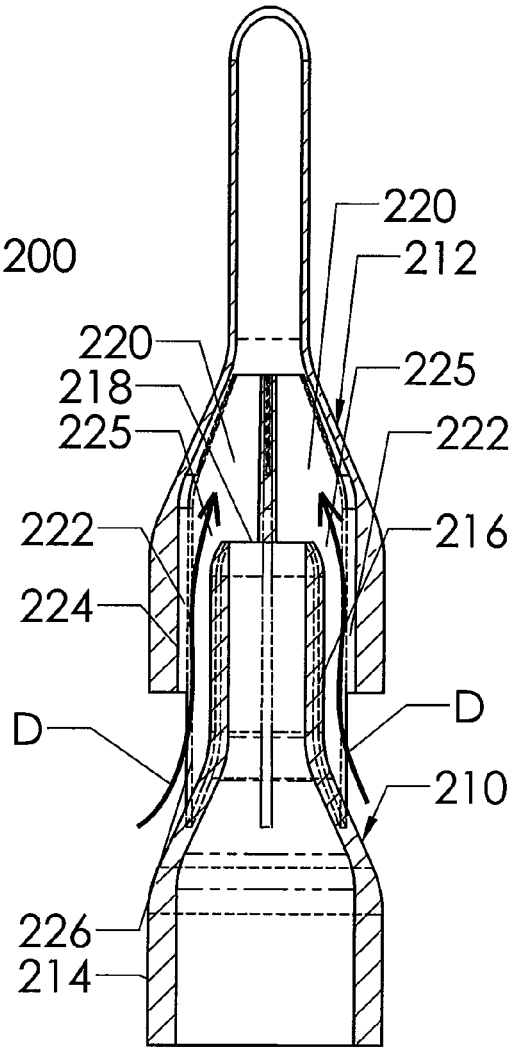

In accordance with other embodiments of this invention, one or more of the nozzle adaptors are altered to provide further pressure and heat reduction. In FIG. 10, an alternative to the nozzle adaptor 50C is provided and is particularly suited for filling large foil balloons. This nozzle adaptor is identified by the numeral 150C, and, because it is substantially similar to the nozzle adaptor 50C already disclosed, like parts will receive like numerals though increased by 100. Thus, nozzle adaptor 150C includes an inlet end 151C that intimately fits over the inflation nozzle 17, and tapers to a narrow outlet end 153C to provide an alternate outlet 152C. A tab 156C is provided at the inlet end 151C to function as already disclosed with respect to the tab 56C. The nozzle adaptor 150C differs from the nozzle adaptor 50C in that multiple vent channels 186 are formed in the inlet end 151C. As seen in the cross section of FIG. 11, when the nozzle adaptor 150C is received on the inflation nozzle 17, the open top of the vent channels 186 are closed off by the exterior surface 19 of the inflation nozzle 17 such that air paths are defined between the inlets 187 (FIG. 11) that communicate with the interior of the nozzle adaptor 50C and outlets 188 that communicate with the atmosphere. The inlets 187 are formed by the length of the channels 186 that extend beyond the exterior sidewall of the inflation nozzle 17. Like the nozzle adaptor 50C, the nozzle adaptor 150C fits over the appropriate post P in the balloon inflator 10, and its tab 156C depresses the actuator switch 64 when stored. When the nozzle adaptor 150C is removed from its post P and placed on the inflation nozzle 17, and a foil balloon is fitted over its outlet 152C, the diode D1 permits only half of the wave form of the alternating current to pass through the circuit to energize the motor, dependant upon the state of either switch 66 or switch 84, as already disclosed. Additionally, due to the backpressure created as a result of the balloon being fitted over the outlet 152C, a portion of the inflating air is directed out through the vent channels 186, flowing, due to the backpressure, in at inlets 187 and out to the atmosphere at outlets 188. This nozzle structure thus further decreases the pressure and temperature of the inflating air. The decrease in pressure is approximately a 15% decrease, when there are 7 vent channels 186, as shown, with the vent channels being half circles in cross section and having a depth of approximately half the thickness of the sidewall defining the inlet end 151C.

It should be appreciated that, while the vent channel concept is shown as employed to alter the large foil balloon adaptor 50C, it could be employed with other adaptors, such as 50A or 50B, as well. Such alteration would cause those adaptors to yield inflating air at lower pressure and temperature, even though the adaptor 50C might still be actuating switch 64 to operate the motor at full power.

In yet another embodiment of this invention, as shown in FIGS. 12 through 15, a stacked nozzle adaptor assembly 200 is provided for selective use on the inflation nozzle 17 of the balloon inflator 10. This stacked nozzle adaptor assembly 200 can be used either when switch 64 is actuated or when it is not actuated, according to the desire of the end user of the inflator 10; however, this assembly 200 has been particularly provided to be employed either with the present inflator 10 at full power (with switch 64 actuated) or with older prior art inflation systems, such as that in U.S. Pat. No. 5,199,847, where a lower power option is not provided (i.e., where there is no switch like switch 64). The stacked nozzle adaptor assembly 200 includes a base nozzle 210 and a top nozzle 212. The base nozzle 210 includes an inlet end 214 that intimately fits over the inflation nozzle 17, and tapers to a narrow outlet end 216 to provide an alternate outlet 218. A plurality of fins 220 extend outwardly from the exterior surface of the narrow outlet end 216 to generally define multiple vent channels 222 between neighboring fins 220. More particularly, as seen in the cross section of FIGS. 14 and 15, when the top nozzle 212 is received on the base nozzle 210, the vent channels 222 are closed off by the interior surface 224 of the top nozzle 212 such that air paths are defined between the inlets 225 that communicate with the interior of the top nozzle 212 and outlets 226 that communicate with the atmosphere. The inlets 225 are formed by the length of the fins 220 that extend beyond the outlet 218 of the base nozzle 210. When the stacked nozzle adaptor assembly 200 is placed on the inflation nozzle 17, and a balloon is fitted over the outlet 228 of the top nozzle 212, a portion of the inflating air is directed out through the vent channels 222 as represented at arrows C, due to the backpressure created as a result of the balloon being fitted over the outlet 228.

When the balloon is removed from the outlet 228 and backpressure is thereby reduced, a venturi effect is realized, and cool air is drawn in from the atmosphere at outlets 226, as generally represented at arrows D. This helps to flush out warm air generated from the motor and built up during a backpressure situation.

In light of the forgoing, it should be apparent that this invention provides advancements in the art of balloon inflators. Particular concepts disclosed herein may be practiced alone or in combination with other features, and this invention is not limited to or by any particular embodiment disclosed. The claims will serve to define the invention.

The invention claimed is:

1. A balloon inflator comprising:

a housing;

a motor within said housing;

a fan operable by said motor to drive air;

an inflation nozzle receiving air driven by said fan, said inflation nozzle having an outlet;

a nozzle adaptor configured to fit over said outlet of said inflation nozzle and provide an alternate outlet;

a nozzle receipt in said housing to selectively receive said nozzle adaptor; and a switch at said nozzle receipt, wherein said nozzle adaptor is selectively received at said nozzle receipt so as to trigger said switch, and selectively removed from said nozzle receipt so as to not trigger said switch, said switch controlling the power supplied to said motor, such that different motor operating parameters are realized when said switch is triggered and when said switch is not triggered.

2. The balloon inflator of claim 1, wherein said fan is retained in said housing.

3. The balloon inflator of claim 1, wherein said nozzle adaptor is intended for filling a large foil balloon having a neck that retains a self-sealing valve.

4. The balloon inflator of claim 3, wherein, when said switch is triggered, said motor operates said fan at a first power level and, when said switch is not triggered, said motor operates said fan at a second power level lower than said first power level.

5. The balloon inflator of claim 4, wherein said motor is powered by alternating current (AC), and, when said switch is triggered by said nozzle adaptor, the entire wave form of the alternating current energizes the motor, and, when said switch is not triggered by said nozzle adaptor, less than the entire wave form of the alternating current energizes the motor.

6. The balloon inflator of claim 5, wherein, when said switch is not triggered by said nozzle adaptor, the alternating current is forced through a diode that permits only half of the wave form of the alternating current to energize the motor.

7. The balloon inflator of claim 1, further comprising:

a second nozzle adaptor and second nozzle receipt.

8. The balloon inflator of claim 3, further comprising:

a second nozzle adaptor and second nozzle receipt, the second nozzle adaptor being provided to fill one of either small foil balloons or latex balloons.

9. The balloon inflator of claim 8, further comprising:

a third nozzle adaptor and third nozzle receipt, the second nozzle adaptor being provided to fill small foil balloons, and the third nozzle adaptor being provided to fill latex balloons.

10. The balloon inflator of claim 9, wherein at least one of said nozzle receipt, said second nozzle receipt and said third nozzle receipt is a keyed nozzle receipt to ensure that only a particular one of said nozzle, said second nozzle or said third nozzle can be received at that keyed nozzle receipt.

11. A balloon inflator comprising:

a housing;

a motor within said housing;

a fan operable by said motor to drive air;

an inflation nozzle receiving air driven by said fan, said inflation nozzle having an outlet; and a nozzle adaptor configured to fit over said outlet of said inflation nozzle and provide an alternate outlet for said air driven by said fan, said nozzle adaptor including vent channels that exhaust a portion of said air when a balloon is fitted over said alternate outlet to receive air driven through said nozzle and said nozzle adaptor, wherein said nozzle adaptor provides an inlet end that intimately fits over said inflation nozzle and said vent channels are formed in said inlet end to have open tops defined at an interior circumferential surface of said inlet end, said inflation nozzle closing off at least a portion of said open tops.

12. A balloon inflator comprising:

a housing;

a motor within said housing;

a fan operable by said motor to drive air;

an inflation nozzle receiving air driven by said fan, said inflation nozzle having an outlet; and a stacked nozzle adaptor assembly configured to fit over said outlet of said inflation nozzle and provide an alternate outlet for said air driven by said fan, said nozzle adaptor assembly including vent channels that exhaust a portion of said air when a balloon is fitted over said alternate outlet to receive air driven through said nozzle and said nozzle adaptor assembly, wherein said stacked nozzle adaptor assembly includes a base nozzle having an inlet end that intimately fits over an inlet end of said inflation nozzle and a plurality of fins extending outwardly from an exterior surface of said base nozzle; and a top nozzle fitting intimately over said plurality of fins to define multiple vent channels.

* * * * *